United States Patent [19]

Myers

[11] Patent Number: 4,936,273

[45] Date of Patent: Jun. 26, 1990

[54] DECOMPRESSION SYSTEM FOR DIESEL ENGINES

[76] Inventor: Vaughn D. Myers, Mile 103.5 Sterling Hwy., Soldotna, Ak. 99669

[21] Appl. No.: 344,810

[22] Filed: Apr. 28, 1989

[51] Int. Cl.[5] ..... F02D 13/04; F01L 13/08

[52] U.S. Cl. ..... 123/321; 123/182; 123/322

[58] Field of Search ..... 123/322, 321, 320, 182, 123/90.12, 198 F, 316

[56] References Cited

U.S. PATENT DOCUMENTS

| | | | |
|---|---|---|---|
| 827,810 | 8/1906 | Mohrdieck . | |
| 1,188,501 | 6/1916 | Smith . | |
| 2,067,449 | 1/1937 | Hudson et al. | 123/182 |
| 2,116,175 | 5/1938 | Loeffler | 123/182 |
| 2,183,558 | 12/1939 | Godfrey | 123/182 |
| 2,323,304 | 7/1943 | Bowman | 123/182 |
| 3,220,392 | 11/1965 | Cummins | 123/321 |
| 4,161,166 | 7/1979 | Roznovsky | 123/182 |
| 4,200,079 | 4/1980 | Darlington | 123/179 G |
| 4,271,796 | 6/1981 | Sickler et al. | 123/322 |
| 4,393,832 | 7/1983 | Samuel et al. | 123/327 |
| 4,572,114 | 2/1986 | Sickler | 123/321 |
| 4,664,070 | 5/1987 | Meistrick et al. | 123/321 |
| 4,742,806 | 5/1988 | Tart, Jr. et al. | 123/322 |

OTHER PUBLICATIONS

Instruction Manual for Jacobs Engine Brake, (Models 30 and 30 SN 25A, 25B and 25 BSN).

*Primary Examiner*—Andrew M. Dolinar
*Attorney, Agent, or Firm*—William D. Hall

[57] ABSTRACT

A cylinder of a diesel engine that is used to drive a vehicle is decompressed by opening its exhaust valve. When the engine brake of the vehicle is applied a first high pressure fluid is applied to one side of a shuttle valve moving it in one direction and applying the high pressure to open the exhaust valve. The driver may also decompress the engine, during starting of the engine, for example, by throwing a switch on the vehicle dashboard that starts a fluid pump that applies high pressure fluid to drive the shuttle valve in another direction and to open the exhaust valves. The shuttle valve isolates the two sources of high pressure fluid.

16 Claims, 7 Drawing Sheets

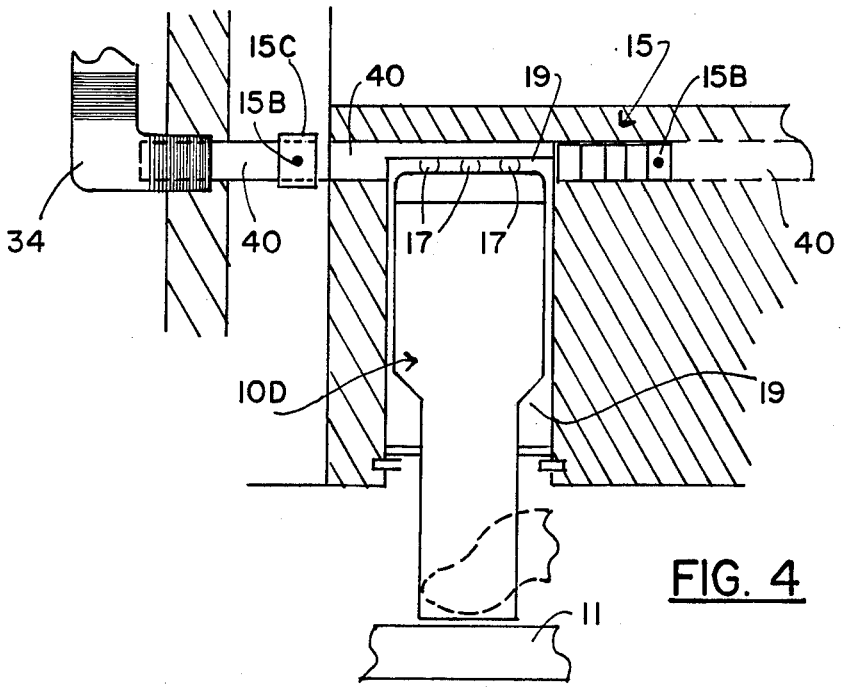
FIG. 4
FIG. 5
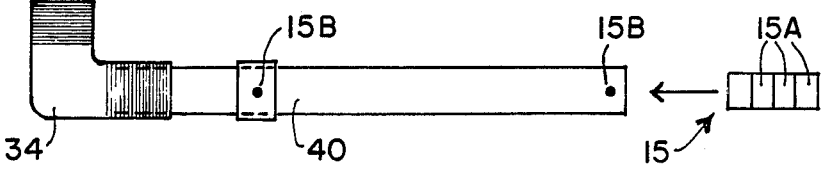
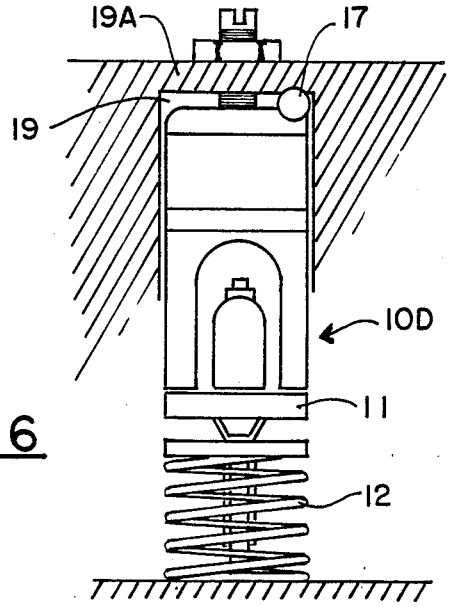
FIG. 6

FIG. 9
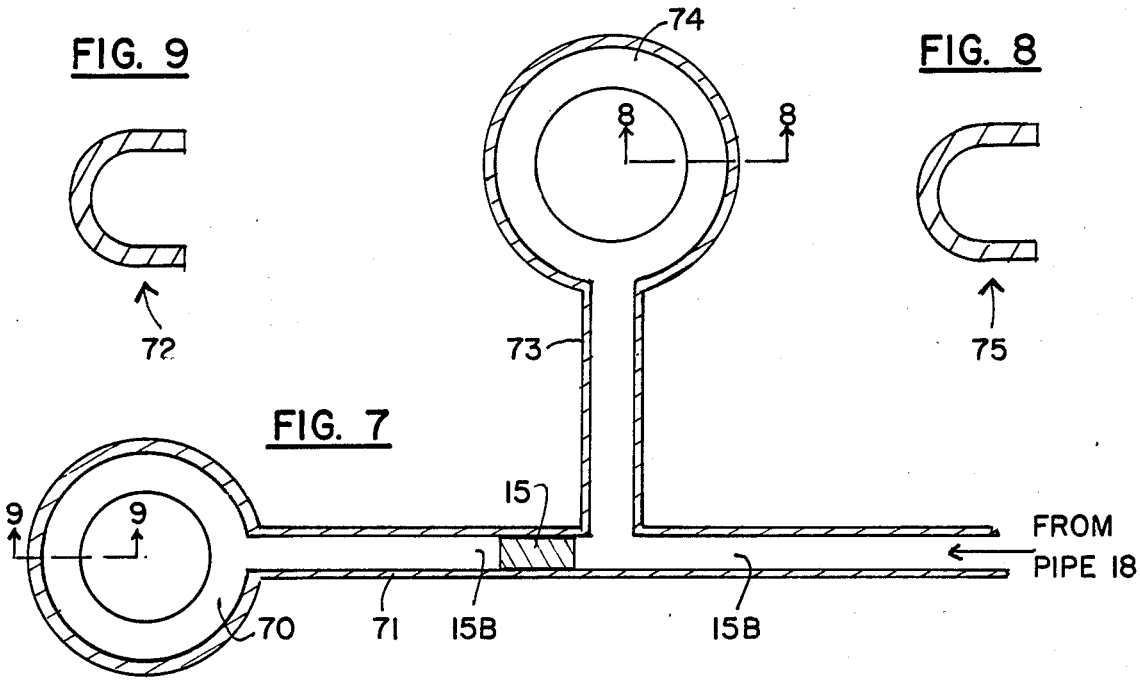
FIG. 8
FIG. 7
FIG. 10
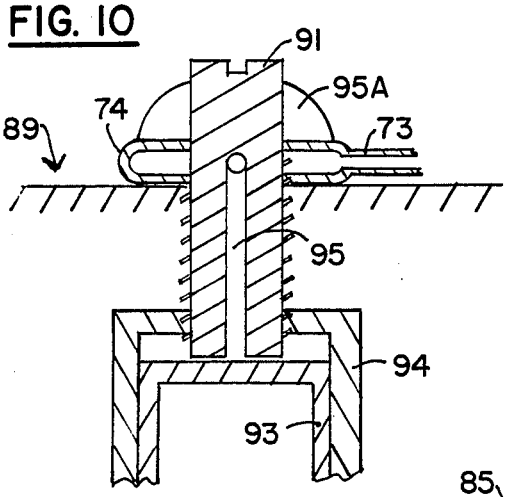
FIG. 12
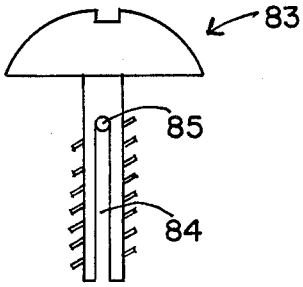
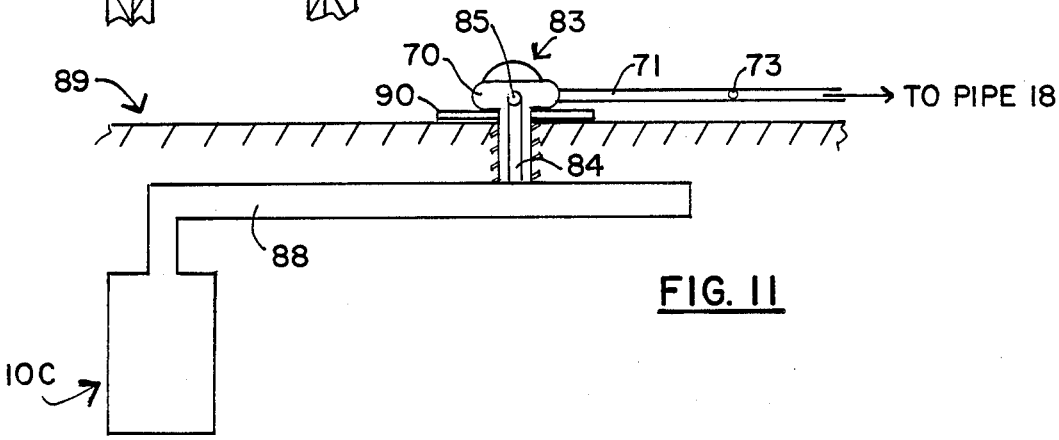
FIG. 11

DECOMPRESSION SYSTEM FOR DIESEL ENGINES

BACKGROUND OF THE INVENTION

This invention relates to systems for decompressing the cylinders of a diesel engine, for example the engine of a vehicle. The present invention provides for decompressing the cylinders at the will of a human operator (for example, a truck driver).

It is commonplace for the engine braking system of a vehicle driven by a diesel engine to decompress the cylinders of the engine, by opening the exhaust valves of the cylinders during engine braking. For example, the so-called Jacobs brake which has been in common use for a number of years has an overhead slave piston which opens the exhaust valves of the cylinders when the engine brake is applied.

It is also well-known that a hydraulic system under control of the truck driver, or other human operator, controls the exhaust valves to decompress some or all of the cylinders during the starting of the diesel engine. One such device is disclosed in Godfrey, U.S. Pat. No. 2,183,558 issued Dec. 19, 1939 and entitled Decompression Device.

SUMMARY OF THE INVENTION

The present invention uses the slave piston of a conventional engine braking system for decompressing the cylinders of a diesel engine at the will of the operator, during engine start-up. The slave piston opens the exhaust valves of a cylinder of the engine when the auxiliary oil pump is activated and oil is made to flow through the compression release mechanism. With my invention, the slave piston is modified to receive oil pressure (and to thereby open the exhaust valves) not only when the engine brake is applied, but also at the will of the human operator. To facilitate the foregoing function I employ a shuttle valve controlling the flow of oil that powers the slave piston. In this respect, when the engine brake is applied high pressure oil from the braking system drives the shuttle valve in one direction. High pressure oil from the braking system is then applied to the slave piston to operate the exhaust valves in the conventional manner. When, however, the engine brake is not applied and the operator desires to decompress the cylinders, high pressure oil from a second source in applied to move the shuttle valve in the other direction (opposite to said one direction). This applies high pressure oil from the second source to the salve piston to open the exhaust valves.

When the brakes are not applied at the same time that the operator has operated the controls to allow normal engine compression, the second source of high pressure oil is turned off or otherwise isolated from the slave piston. The spring on the slave piston normally holds the piston away from valve bridge.

BRIEF DESCRIPTION OF THE DRAWINGS

FIG. 4 illustrates the oil input ports 17 and the shuttle valve 15 that I have added to the otherwise conventional slave piston 10D of the conventional Jacobs brake.

FIG. 5 illustrates the details of the shuttle valve 15.

FIG. 6 is a cross-section of a modified form of the invention where there is only one inlet oil port to the cylinder for slave piston 10D.

FIG. 7 is a cross-sectional view of certain parts of the preferred form of my invention.

FIG. 8 is a sectional view taken along line 8—8 of FIG. 7.

FIG. 9 is a sectional view along the line 9—9 of FIG. 7.

FIG. 10 shows modifications that I have made to the slave piston 10D of the conventional Jacobs brake.

FIG. 11 shows the details of the oil line from the master piston 10C to the slave piston 10D.

FIG. 12 shows the details of bolt 83 of FIG. 11.

DETAILED DESCRIPTION OF THE DRAWINGS

Figure 1:
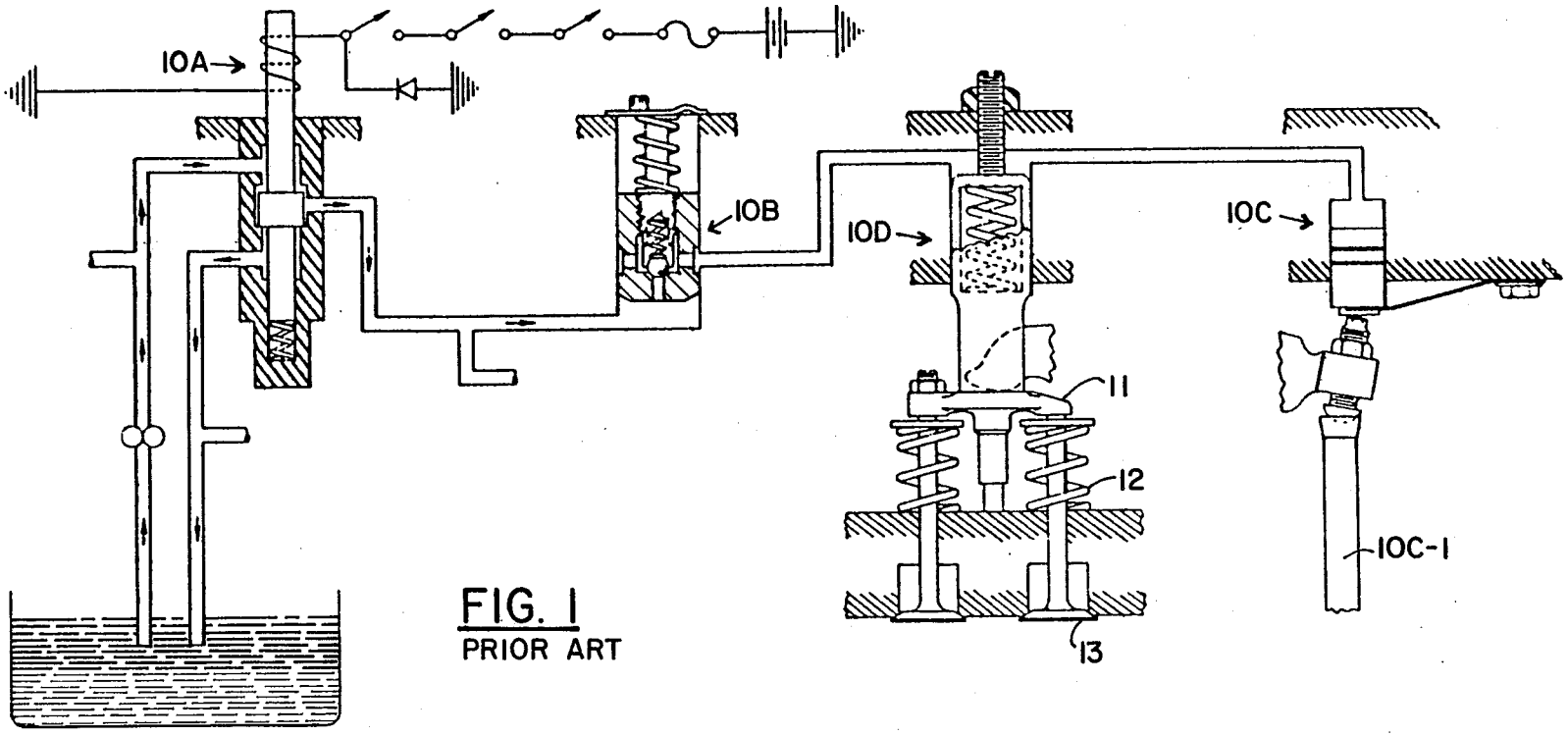
FIG. 1 PRIOR ART
FIG. 1 is a schematic diagram of the well known Jacobs brake of the prior art.

FIG. 1 is a schematic diagram of the well known prior art Jacobs brake for a Cummins diesel engines.

The exhaust valves 13 of FIG. 1 are part of a cylinder of a conventional diesel engine. These valves 13 are normally held closed by the springs 12. When the solenoid valve 10A is energized, oil from the crankcase is pumped at low pressure to the low pressure outlet of solenoid valve 10A and to the inputs of control valve 10B, master piston 10C and slave piston 10D. The pressure is sufficient to move the master piston 10C down against the injector rocker 10C-1 but insufficient to operate the slave piston 10D. Therefore, valves 13 are held closed by springs 12. When, however, the injector arm 10C-1 begins its upward travel (as in a normal injection cycle) the master piston 10C is forced upward, the ball check valve of control valve 10B closes and the oil pressure at the input of the slave piston 10D increases causing exhaust valves 13 to momentarily open while the engine piston is near its top dead center position. This release compressed air from the cylinder of which valves 13 are a part.

Thus, energizing the engine brake of FIG. 1 effectively converts a power producing diesel engine into a power absorbing air compressor. This is accomplished when desired through motion transfer through a master-slave piston arrangement which opens cylinder exhaust valves 13 neat the top of the normal compression stroke releasing the compressed cylinder charge to exhaust.

The blowdown of compressed air to atmospheric pressure prevents the return of energy to the engine piston on the expansion stroke, the effect being a net energy loss since the work done in compressing the cylinder charge is not returned during the expansion process.

Figure 2:
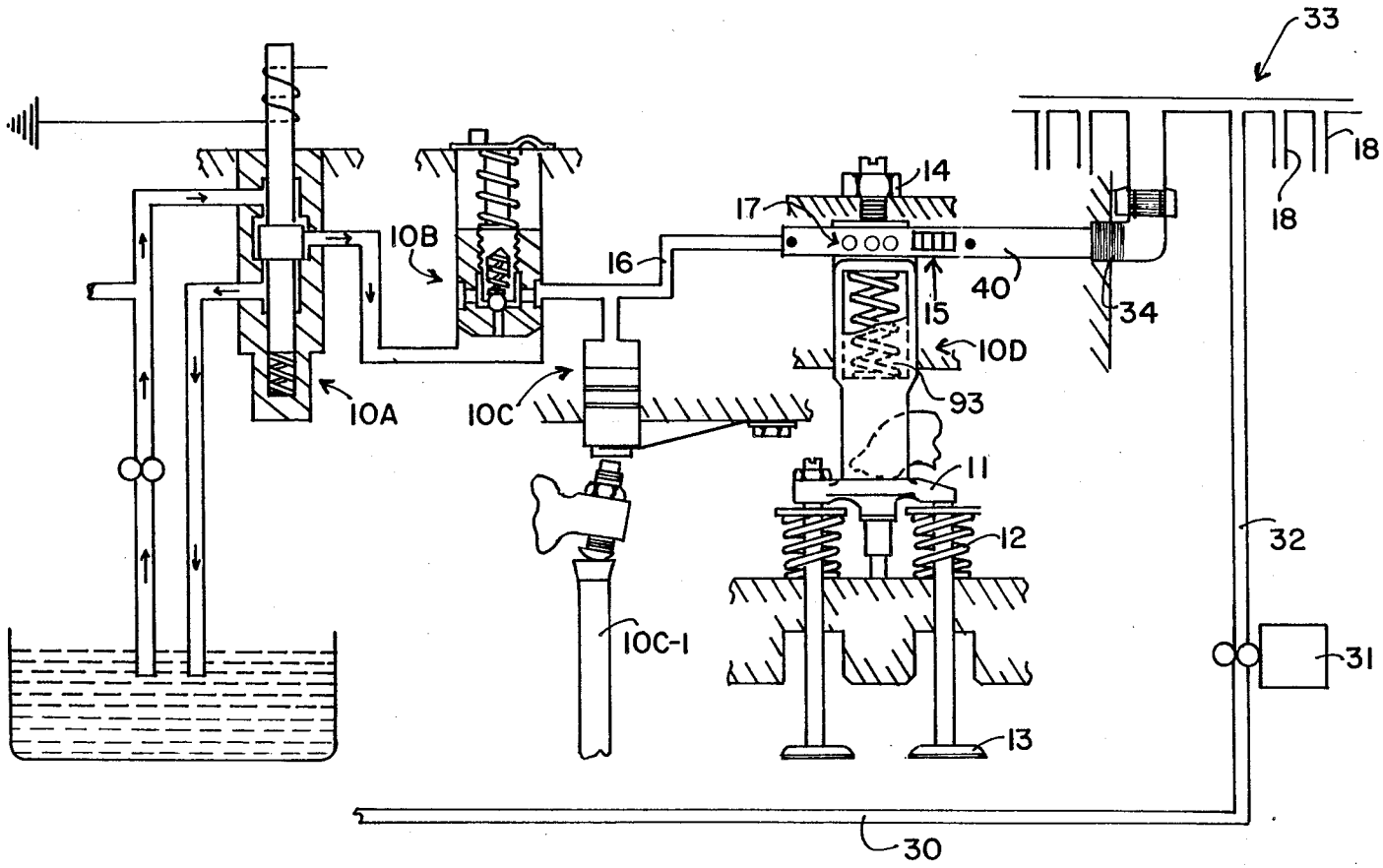
FIG. 2 is a schematic view of the invention wherein a cylinder is decompressed due to application of the brakes.

In FIG. 2 my invention is shown as applied to a truck, having a diesel engine, that has the well-known Jacobs brake 10. My invention utilizes a number of parts of the Jacobs brake without change such as the master piston 10C. I have, however, modified the slave piston 10D by adding (a) one or more oil input holes 17 and (b) the shuttle valve 15 as more fully explained.

The slave piston is driven downwardly when high pressure oil enters oil ports 17. This causes valve bridge 11 to move downward against the bias of springs 12 and open the exhaust valves 13 of the diesel engine.

The oil input line 30 supplies oil to pump 31 which supplies high pressure oil to compression release manifold 33 which has oil output lines 18, one of which feeds oil to compression release valve 34 also known as the shuttle valve.

FIGS. 4 and 5 show the details of the oil ports 17 and the shuttle valve 15. The oil ports 17 are ⅛ inch in diameter and are spaced ¼ inch apart. They lead from the oil line 40 into the cylinder 19 for the slave piston 10D. The oil line 40 has an inside diameter of 0.1875 inches and shuttle valve 15 has an outer diameter of 0.1875. Thus, the shuttle valve 15 makes an oil tight fit inside the pipe. The shuttle valve 15 has three grooves **15*a* to lubricate the shuttle valve 15 and the inside of pipe 0 during operation. The motion of the shuttle valve 15 is limited by two roll pins 15*b*, one at each side of the oil ports 17. The roll pins 15*b* extend across a diameter of pipe 40. One of the roll pins is surrounded by sleeve 15*c* that is around pipe 40. The shuttle valve 15** isolates the two high pressure systems.

The valves 34 may be omitted and replaced by similar valve (FIG. 7) and the decompression accomplished by operating a switch on the dashboard of the vehicle which turns on motor 31. When this motor 31 is started it increases the pressure in manifold 33 which feeds all of the pipes 18 which decompress all of the cylinders in the same manner that exhaust valves 13 decompress the cylinder associated with those valves 13.

FIGS. 7 to 12 illustrates what I believe is the best mode for carrying out my invention. The form of the invention shows in FIGS. 7 to 12 utilized all of the parts of FIG. 1, although the slave piston 10D has been modified. The salve piston 93 of FIG. 10 operates valve bridge 11 and valves 13 as shown in FIG. 2. Springs 12 are also used in the form of the invention shown in FIGS. 7 to 12. Further, the form of the invention shown in FIGS. 7 to 12 also uses the DC motor and oil pump 31, oil supply line 32, compression release oil manifold 33 and pipes 18 of FIG. 2. Compression release valve 34 may be used to control an individual cylinder, in FIGS. 7 to 12, but it is optional and may be omitted.

When the brake is applied, the system of FIGS. 7 to 12 works in the same way to open valves 13, as does FIG. 1, except as follows. When the master piston 10C operates to raise the oil pressure, the high pressure from master piston 10C goes through hole 88, in mounting block 89, to the vertical hole 84 in bolt 83, from the horizontal outlet hole 85 in bolt 83, from the horizontal outlet hole 85 in bolt 83, to the cavity in eyelet 70, to the pipe 71, to the shuttle valve 15 (FIG. 7) which moves to the right, to branch pipe 73, to the cavity in eyelet 74, to the horizontal hole 95A in bolt 91, to vertical hole 95 in bolt 91, to the cavity in cylinder 94 above the slave piston 93. The slave piston 93 then moves downwardly forcing valve bridge 11 (FIG. 2) downwardly and opening valves 13, the same as shown for slave piston 10D in FIG. 2.

In the form of the invention as shown in FIGS. 7–12, the master piston is formed in mounting block 89. The bolt 83 serves the purpose of acting as a conduit for the high pressure oil as explained above but may also hold some other part of the engine, such as part 90, in place. The hollow eyelets 70 and 74 are held in place by bolts 83 and 91 respectively.

In the device of FIGS. 7 to 12, when it is desired to decompress the cylinder at a time that the brake is not applied, the driver closes a switch on the dashboard which starts motor-pump 31 (FIG. 2) to apply high pressure oil to manifold 33 and the various oil lines 18 (one for each cylinder). The high pressure oil in a line 18 enter the right end of pipe 71 (FIG. 7), drives the shuttle valve 15 to the left (as shown), and enters pipe 73 where it passes through the cavity in eyelet 74, through horizontal hole 95A (FIG. 10), and through vertical hole 95 to the cavity in cylinder 94 that is above slave piston 93. The piston 93 moves downward and opens the exhaust valves 13 as explained in connection with FIG. 2.

In FIGS. 7 to 12, the shuttle valve 15 isolates the fluid coming from the master piston 10C through eyelet 70 from the fluid coming from pipe 18.

The invention has been described as to how one of the cylinders of the diesel engine may be decompressed. Clearly, each cylinder of the diesel engine can be decompressed at the same time since a dashboard switch may be closed to start motor-pump 31 and apply high pressure oil through a pipe 18 to each slave piston 10D of each cylinder.

OPERATION

I will first describe the operation of the form of the invention shown in FIG. 2.

Referring to FIG. 2, it may be assumed that the human operator (usually the truck driver) leaves compression release valve 34 open, and also leaves his dashboard switch open so that motor-pump 31 is not running. While he is driving the truck the engine brakes are not applied. Hence, the oil pressure in pipe 16 is low, and the oil at the outlet of manifold 33 is also low. Hence, the oil pressure in pipe 40 is low. Thus, no matter where shuttle valve 15 is positioned on the upper end of slave piston 10D, the oil pressure at ports 17 will be too low to overcome the bias of spring 12 and the exhaust valves 13 will remain closed. Hence, the pressure due to compression, will build up in the cylinders of the diesel engine, and ignite the mixtures.

Let it now be assumed that while the above condition, as set forth in the immediately preceding paragraph, prevails the driver applies the Jacobs brake. The parts 10A, 10B and 10C (FIG. 2) will then function in the conventional manner and apply high pressure to oil line 16 which will apply high pressure oil to pipe 40. Unless the shuttle valve 15 is already in its right-handed location, the high pressure on the left side of the shuttle valve 15 will drive it to the right, exposing oil ports 17 to the high pressure oil in pipes 16 and 40, as shown in FIG. 2. The slave piston 10D will move downwardly overcoming the bias of spring 12 and cause valve bridge 11 to open the exhaust valves 13 of a main cylinder of the diesel engine; whereby a main cylinder of the diesel engine is decompressed. The other cylinders of the diesel engine may be decompressed in the same way.

Figure 3:
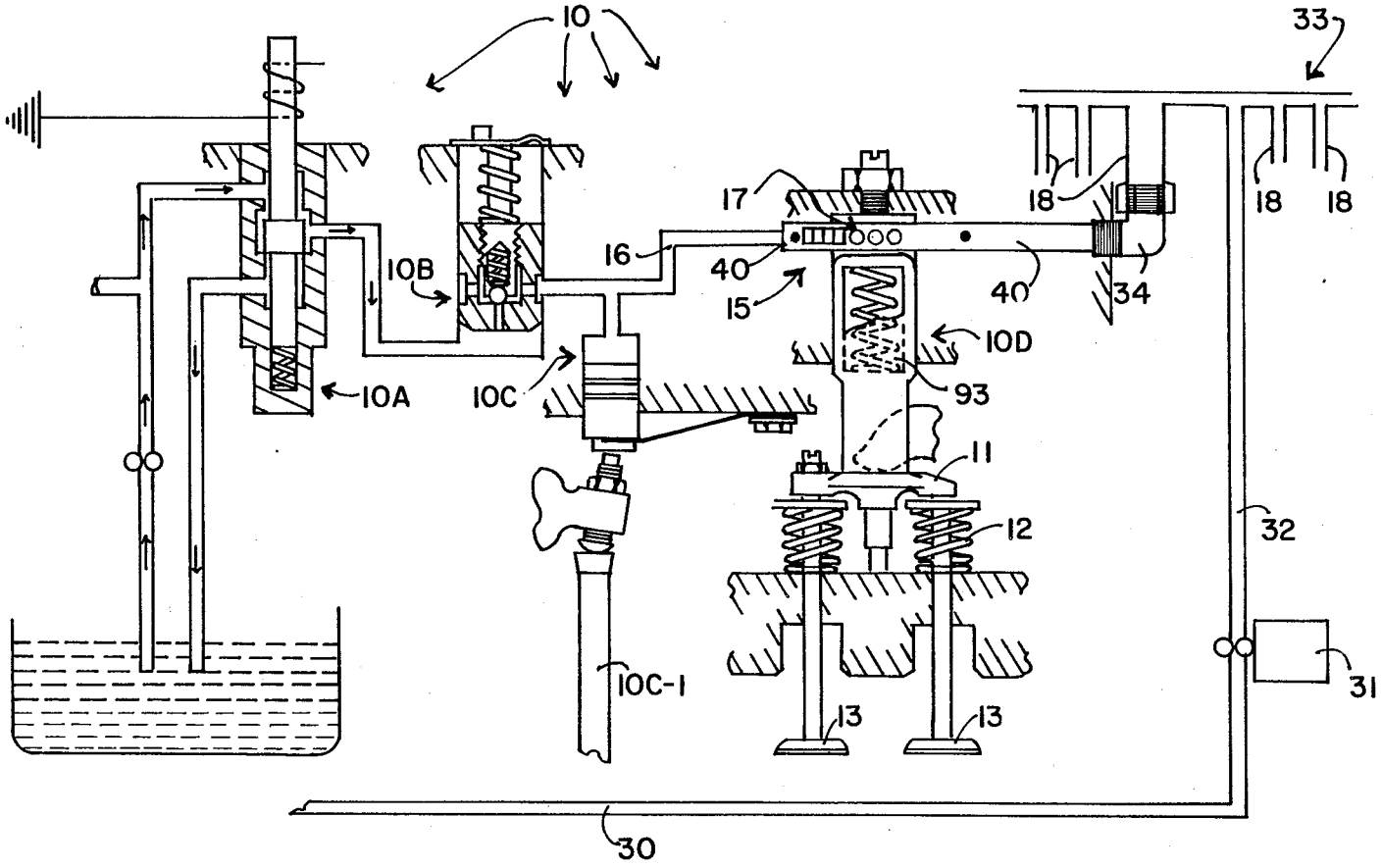
FIG. 3 is a schematic view of the invention wherein a cylinder is decompressed by the human operator who has operated controls to decompress the cylinder.

Let it next be assumed that the truck stops and the engine is turned off. Then assume that the driver wishes to start the engine. He may wish to decompress the cylinder which has exhaust valves 13 (See FIG. 3). The oil pressure in oil line 16 is low and, therefore, that oil pressure cannot overcome the bias of springs 12. The driver will now start motor-pump 31, allowing high pressure oil to be applied from manifold 33 to the right-hand end of shuttle valve 15, driving it to the left. The high pressure oil from manifold 33 is now applied to slave piston 10D and the resulting high pressure overcomes the bias of springs 12 and opens valves 13, thereby decompressing the main cylinder of the diesel engine which is associated with exhaust valve 13, as shown in FIG. 3.

I will next explain the operation of the form of the invention shown in FIGS. 7 to 12.

When the motor-pump 31 is off and the vehicle engine brake has not been applied, the pressure in all oil lines is low, and the springs 12 hold valves 13 normally closed. If it is next assumed that the engine brake is applied, the oil pressure at the output of master piston 10C rises, increasing the pressure in pipe 88, vertical hole 84, horizontal hole 85, and pipe 71 driving shuttle valve 15 to the right. The pressure in pipe 73 then rises increasing the pressure in eyelet 74, horizontal hole 95A, vertical hole 95 and in the cavity above piston 93. Piston 93 then moves down, opening valves 13 decompressing the engine. The movement of the pistons, with exhaust valves 13, applies a braking force to the vehicle.

If, however, the vehicle is at rest and it is desired to decompress the cylinders upon starting the engine, the motor-pump 31 is started raising the pressure in pipes 18 (FIG. 2). This drives shuttle valve 15 (FIG. 7) to the left, allowing high pressure oil from the pipe 18 to enter pipe 73, to enter the cavity in eyelet 74, and to pass through the holes 95A and 95 to the cavity above piston 93 (FIG. 10). This opens valves 13 decompressing the engine.

I claim to have invented:

1. Apparatus for decompressing a cylinder of a diesel engine that drives a vehicle, comprising:

cylinder exhaust valve means for decompressing said cylinder of said diesel engine when the valve is open, piston means operable to open said valve means when said piston means is moved in one direction, first means for providing high pressure fluid when the brake of said vehicle is applied, second means for providing high pressure fluid, and means for applying the high pressure fluid, from either said first means or said second means, to said piston means to move said piston means in said one direction to open said exhaust valves.

2. Apparatus as defined in claim 1 in which said means for applying high pressure fluid to said piston comprises a shuttle valve.

3. Apparatus as defined in claim 2 in which said shuttle valve moves in one direction in response to high pressure fluid from said first means and in a second direction in response to high pressure fluid from said second means.

4. Apparatus as defined in claim 3, in which high pressure fluid from either said first means or said second means will not only move said shuttle valve but will pass to said piston means to move said piston means and open said valve.

5. Apparatus as defined in claim 1 in which said second means is under control of the driver of the vehicle to provide high pressure fluid upon command of the driver.

6. Apparatus as defined in claim 1, in which said means for applying high pressure fluid has two inputs and one output, said two inputs being connected to said first means and said second means respectively, and said output being connected to said piston means.

7. Apparatus as defined in claim 6 in which said means for applying high pressure fluid includes a shuttle valve driven in one direction by high pressure fluid at one of said inputs and driven in the other direction by high pressure fluid at the other of said inputs, said means for applying high pressure fluid comprising means for applying high pressure fluid to said output when there is high pressure fluid at either of said inputs.

8. Apparatus as defined in claim 7 in which said shuttle valve comprises means for preventing high pressure fluid at either one of said inputs from affecting the pressure at the other of said inputs.

9. Apparatus as defined in claim 8, in which a cylinder for said piston means receives the high pressure fluid that operates the piston means; and annular tube, fed by said fluid from said outlet, and positioned adjacent said cylinder for said piston means; and an adjusting screw passing through said annular means and bearing on said piston means for limiting the travel of said piston means in one direction, said adjusting screw defining an internal hole that communicates the fluid pressure in said annular tube to said cylinder for said piston means.

10. Apparatus as defined in claim 9, in which said first means includes a master piston for applying high pressure to the fluid at said input which is connected to said first means; said master piston having a high pressure outlet; means defining a hole for the fluid from said high pressure outlet; a bolt having an end which enters said hole in said means; and an annular tube surrounding said bolt and constituting one of said inputs of said means for applying high pressure; said bolt defining an internal hole for communicating the fluid pressure in said hole in said means to said annular tube that surrounds said bolt.

11. In a vehicle, driven by a diesel engine of the type having at least one cylinder with an exhaust valve, having a braking system of the type that opens said exhaust valve to decompress said cylinder:

first means responsive to high pressure fluid for opening said exhaust valve, said braking system including means for applying high pressure fluid to said exhaust valve to thus apply braking to said vehicle, and driver controlled means for applying high pressure fluid to said first means to decompress said cylinder during starting of the vehicle.

12. In a vehicle as defined in claim 11; means for isolating the pressure applied by said braking system and the pressure applied by said driver controlled means.

13. In a vehicle as defined in claim 12:

said means for isolating comprising a shuttle valve.

14. In a vehicle as defined in claim 13 said shuttle valve having first and second ends and movable between first and second positions, said braking means applying high pressure fluid to said first end to move said shuttle valve to said second position and to apply the pressure of said braking system to said first means, said driver controlled means applying high pressure to fluid to said second end to move said shuttle valve to said first position and to apply the pressure of said driver controlled means to said first means.

15. In a vehicle as defined in claim 14, said shuttle valve having an output between said first and second positions, said output of said shuttle valve being connected to said first means.

16. The method of decompressing a cylinder of a diesel engine that is used to drive a vehicle that has a brake, comprising:

providing an exhaust valve for said cylinder, providing a shuttle valve, applying a first fluid pressure to move said shuttle valve in one direction and to open said exhaust valve when said brake is applied, applying a second fluid pressure under the control of the driver of the vehicle, to move said shuttle valve in another direction opposite to said one direction and to open said exhaust valve, and isolating said first and second fluid pressures from each other with said shuttle valve.

* * * * *